US011866288B2

(12) United States Patent
Yui et al.

(10) Patent No.: US 11,866,288 B2
(45) Date of Patent: Jan. 9, 2024

(54) WIRE WINDING DEVICE AND WIRE WINDING METHOD

(71) Applicant: TOKUSEN KOGYO CO., LTD., Ono (JP)

(72) Inventors: Kiyoshi Yui, Ono (JP); Takuto Fujisawa, Ono (JP)

(73) Assignee: TOKUSEN KOGYO CO., LTD., Ono (JP)

( * ) Notice: Subject to any disclaimer, the term of this patent is extended or adjusted under 35 U.S.C. 154(b) by 822 days.

(21) Appl. No.: 16/968,730

(22) PCT Filed: Feb. 5, 2020

(86) PCT No.: PCT/JP2020/004227
§ 371 (c)(1),
(2) Date: Aug. 10, 2020

(87) PCT Pub. No.: WO2020/183991
PCT Pub. Date: Sep. 17, 2020

(65) Prior Publication Data

US 2021/0371230 A1 Dec. 2, 2021

(30) Foreign Application Priority Data

Mar. 8, 2019 (JP) ..... 2019-042567

(51) Int. Cl.

| | |
|---|---|
| ***B65H 54/12*** | (2006.01) |
| ***B21C 47/26*** | (2006.01) |
| ***B65H 54/22*** | (2006.01) |
| ***B65H 65/00*** | (2006.01) |
| *B65H 75/28* | (2006.01) |

(52) U.S. Cl.
CPC ..... *B65H 54/12* (2013.01); *B21C 47/26* (2013.01); *B65H 54/22* (2013.01); *B65H 65/00* (2013.01); *B65H 75/285* (2013.01)

(58) Field of Classification Search
CPC ..... B65H 54/12; B65H 54/22; B65H 65/00; B65H 65/005; B65H 75/285
See application file for complete search history.

(56) References Cited

U.S. PATENT DOCUMENTS

| | | | | |
|---|---|---|---|---|
| 5,549,257 | A * | 8/1996 | Sanda | B65H 75/28 242/580 |
| 5,931,408 | A * | 8/1999 | Ishii | B65H 75/28 242/125.3 |
| 2002/0038516 | A1 * | 4/2002 | Kinoshita | B65H 65/00 33/520 |

FOREIGN PATENT DOCUMENTS

| | | |
|---|---|---|
| JP | 2002-104736 A | 4/2002 |

* cited by examiner

*Primary Examiner* — Sang K Kim
(74) *Attorney, Agent, or Firm* — Sughrue Mion, PLLC

(57) ABSTRACT

A wire winding device includes a lock jig including a pair of tip end portions configured to approach each other or separate from each other. A control portion of the wire winding device is configured to execute: a step of winding a wire onto a winding drum; and a step of making the lock jig sandwich a pulled-out part of the wire, inserting the lock jig into a clip, and opening the tip end portions of the lock jig against biasing force of the clip to open the clip.

9 Claims, 10 Drawing Sheets

WIRE WINDING DEVICE AND WIRE WINDING METHOD

CROSS REFERENCE TO RELATED APPLICATIONS

This application is a National Stage of International Application No. PCT/JP2020/004227 filed Feb. 5, 2020, claiming priority based on Japanese Patent Application No. 2019-042567 filed Mar. 8, 2019.

TECHNICAL FIELD

The present invention relates to a device and method of winding a wire onto a reel and locking the wire.

BACKGROUND ART

A wire, such as a steel cord, is wound onto a reel, and a terminal end portion of the wire is locked to a clip provided at the reel. Such wires are distributed together with the reels. PTL 1 discloses a device configured to automate such winding and locking.

This device is applied to a reel configured such that a clip is attached to an inner surface of a flange of the reel. When locking the wire, the clip is pushed in an axial direction from an outside of the flange and opens inside the flange. With the clip open, a pin is hooked onto the wire and then moved, and with this, the terminal end portion of the wire is put in the clip.

CITATION LIST

Patent Literature

PTL 1: Japanese Laid-Open Patent Application Publication No. 2002-104736

SUMMARY OF INVENTION

Technical Problem

According to some reels, the clip is completely covered with the flange when viewed from the axial direction, and therefore, the clip cannot be pushed in the axial direction from the outside of the flange. When the above device is applied to such reels, the clip cannot be opened, and therefore, the terminal end portion cannot be locked.

An object of the present invention is to provide a device and method capable of automating an operation of locking a wire to a clip even when the clip is covered with a flange.

Solution to Problem

A wire winding device according to one aspect of the present invention is a device configured to wind a wire onto a reel and lock the wire. The reel includes: a winding drum onto which the wire is wound; first and second flanges provided at both ends of the winding drum; and a clip configured to lock a pulled-out part of the wire, the pulled-out part being pulled out from a wound part of the wire, the wound part being wound onto the winding drum. The clip includes a base end portion and a tip end portion, the base end portion being supported by an inner surface of a first flange of the reel and located at an inner circumferential side in a radial direction, the tip end portion being located at an outer circumferential side in the radial direction, an interval between the tip end portion and the inner surface being changed by elastic deformation of the clip using the base end portion as a fulcrum. The wire winding device includes: a reel driving portion configured to rotate the reel; a wire feeding portion configured to supply the wire to the reel while applying tension to the pulled-out part; a lock jig including a pair of tip end portions configured to approach each other or separate from each other; a lock jig driving portion configured to make the lock jig move and make the pair of tip end portions of the lock jig approach each other or separate from each other; and a control portion. The control portion is configured to execute a step of controlling the reel driving portion and the wire feeding portion to wind the wire onto the winding drum and a step of controlling the lock jig driving portion to make the lock jig sandwich the pulled-out part, insert the lock jig into the clip, and open the tip end portions of the lock jig against biasing force of the clip to open the clip.

According to the above configuration, the operation of opening the clip is performed inside the flange by the operation of the lock jig. When the clip opens, the wire is pulled inward in the radial direction by tension and separates from the lock jig in an open state to be put in the clip. Even when the clip cannot be opened from an outside of the flange, work of locking the wire to the clip can be automated.

The wire winding device may include a wire lifting portion configured to lift the pulled-out part outward in the radial direction. The control portion may be configured to, after the step of winding the wire onto the winding drum, execute a step of controlling the wire lifting portion to lift the pulled-out part outward in the radial direction at a position that overlaps the clip when viewed in the radial direction. In the step of making the lock jig sandwich the pulled-out part, a portion of the pulled-out part which portion is lifted by the wire lifting portion may be sandwiched by the lock jig.

According to the above configuration, since the pulled-out part is lifted at a position that overlaps the clip, the operation of sandwiching the wire by the lock jig is easily performed.

The wire lifting portion may include one or more pins arranged outside the first flange in the radial direction and a pin driving portion configured to move the one or more pins in an axial direction and a circumferential direction. The one or more pins may be moved by the pin driving portion in the axial direction between an evacuation position where tip ends of the one or more pins are located outside the first flange in the axial direction and an approach position where the tip ends of the one or more pins are located inside the first flange in the axial direction. The control portion may be configured to control the pin driving portion to move the one or more pins from the evacuation position to the approach position in a space between the pulled-out part and the first flange in the radial direction, move the one or more pins in the circumferential direction to lift the pulled-out part by the one or more pins to an outside of the first flange in the radial direction, and stop the one or more pins such that the clip is opposed to the one or more pins in the radial direction.

According to the above configuration, the pulled-out part can be lifted inside the flange, and the pulled-out part can be surely sandwiched by the lock jig. Then, the sandwiched wire body can be locked to the clip located inside the flange.

The one or more pins may include a pair of pins arranged away from each other in the circumferential direction. An interval between the pair of pins may be wider than each of a width of the clip and a width of the lock jig. The control portion may be configured to control the lock jig driving portion to stop the pins such that the clip is located between the pair of pins when viewed in the radial direction and control the lock jig driving portion to position the lock jig between the pair of pins and make the lock jig sandwich a portion of the wire which portion extends between the pair of pins.

According to the above configuration, the pulled-out part linearly extends between the pair of pins, and this part is positioned at an outer circumferential side of the clip in the radial direction and sandwiched by the lock jig. Thus, the lock jig can surely sandwich the wire, and the sandwiched wire is easily put in the clip.

The wire winding device may further include a clip position sensor configured to detect a rotational position of the clip. The control portion may be configured to control the reel driving portion based on the rotational position detected by the clip position sensor, to position the clip at a predetermined lock position and stop the reel, the predetermined lock position being a position to which the lock jig is moved in the radial direction.

According to the above configuration, the position of the clip and the position where the pulled-out part is lifted can be made to coincide with each other in the circumferential direction. Therefore, the wire can be surely sandwiched by the lock jig and can be surely inserted into the clip.

The wire feeding portion may include a traverse roller onto which the pulled-out part is wound at a position opposed to the reel, the traverse roller being configured to be movable in the axial direction. The control portion may be configured to control the reel driving portion and the traverse roller to wind the wire onto the winding drum while adjusting in the axial direction a supply position of the wire supplied to the reel, and control the traverse roller before the lock jig sandwiches the pulled-out part, to move the traverse roller such that the pulled-out part is pulled out from the wound part to an outside of the first flange in the axial direction.

According to the above configuration, the part sandwiched by the lock jig and the position of the clip can be made to coincide with each other in the axial direction, and with this, work of locking the wire can be surely performed. Such positioning is performed by utilizing axial displacement of a conventional traverse roller for winding. Thus, the device can be prevented from becoming complex.

The lock jig driving portion may include a lock jig supporting body supporting the lock jig. A position adjustment jig configured to adjust a position of the lock jig relative to the reel may be coupled to the lock jig supporting body.

According to the above configuration, even when the shapes of the reels are different from each other, the positional deviation of the lock jig with respect to the reels and the clips attached to the reels can be prevented. Thus, the wire can be surely locked to the clip by using the lock jig.

The clip may be covered with the first flange when viewed from an outside in the axial direction.

According to the above configuration, the locking operation can be automated even when the clip is covered with the flange.

A wire winding method according to another aspect of the present invention is a method of winding a wire onto a reel and locking the wire to the reel. The reel includes a winding drum onto which the wire is wound, first and second flanges provided at both ends of the winding drum, and a clip to which a pulled-out part of the wire is locked, the pulled-out part being pulled out from a wound part of the wire, the wound part being wound onto the winding drum. The clip includes a base end portion supported by an inner surface of the first flange and located at an inner circumferential side in a radial direction and a tip end portion located at an outer circumferential side in the radial direction, an interval between the tip end portion and the inner surface being changed by elastic deformation of the clip using the base end portion as a fulcrum. The method includes: a step of winding the wire onto the winding drum; and a step of sandwiching the pulled-out part by a lock jig including a pair of tip end portions configured to approach each other or separate from each other, inserting the lock jig into the clip, and opening the tip end portions of the lock jig against biasing force of the clip to open the clip.

According to the above method, the same effects as the above-described wire winding device can be obtained.

Advantageous Effects of Invention

According to the present invention, the operation of locking the wire can be automated even when the clip is covered with the flange.

DESCRIPTION OF EMBODIMENTS

Hereinafter, an embodiment will be described with reference to the drawings. Unless otherwise noted, an axial direction, a radial direction, and a circumferential direction denote respective directions of a reel 90 provided at a wire winding device 1 (i.e., the reel 90 supported by a reel driving portion 2 of the wire winding device 1). In the present embodiment, when the reel 90 is provided at the wire winding device 1, the axial direction is horizontal.

Reel

Figure 1A:
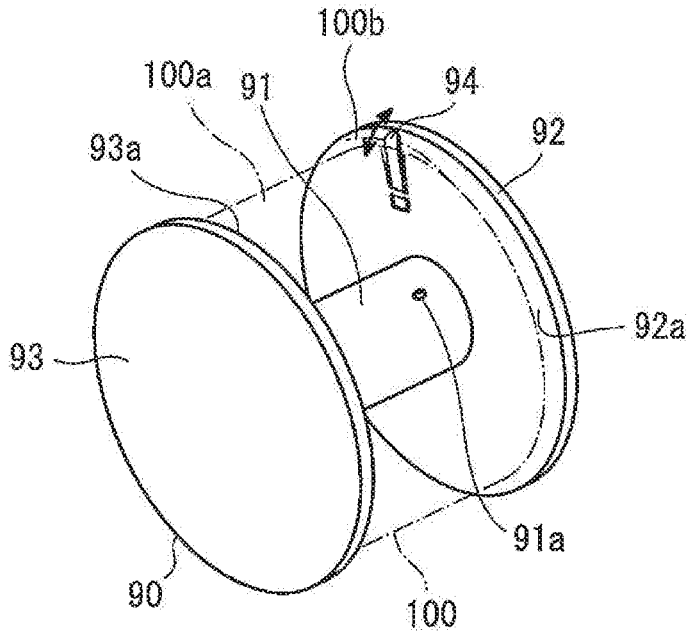
FIG. 1A is a perspective view showing one example of a reel to which a wire winding device according to an embodiment is applied.
Figure 1B:
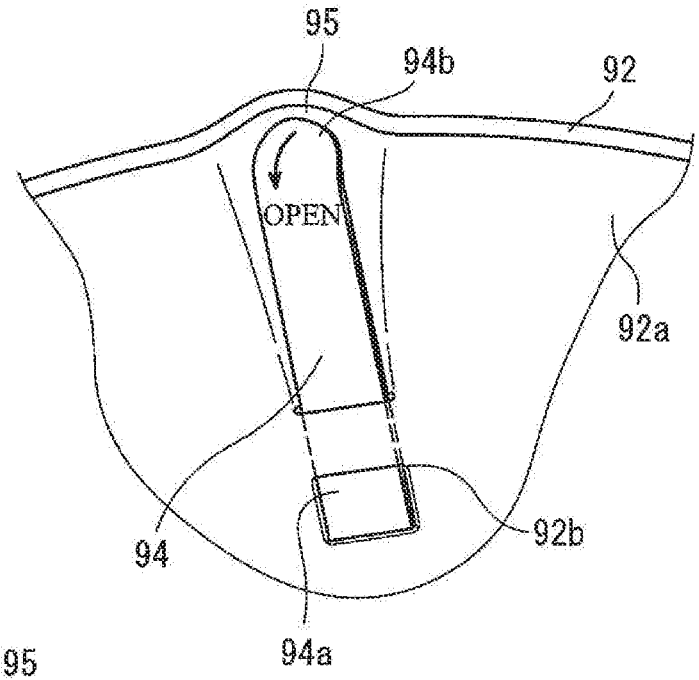
FIG. 1B is a perspective view showing an inner surface of a first flange and a clip.
Figure 1C:
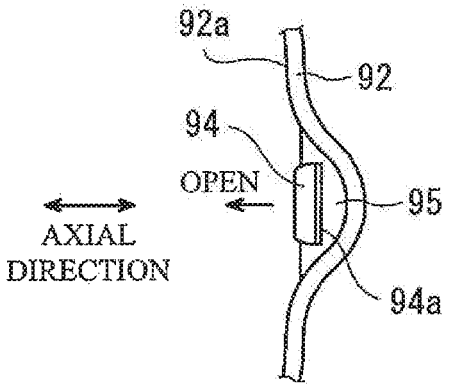
FIG. 1C is a plan view showing the first flange and the clip.

FIGS. 1A to 1C show the reel 90 and a wire 100. As one example, the wire 100 is a metal wire, such as steel. The wire 100 may be a single wire or a twisted wire obtained by twisting a plurality of metal element wires. A steel cord for tire reinforcement is a suitable example of the wire 100.

The reel 90 includes a winding drum 91, a first flange 92, a second flange 93, and a clip 94. The winding drum 91 winds the wire 100. The first flange 92 and the second flange 93 are provided at both ends of the winding drum 91. The winding drum 91 is cylindrical. Each of the flanges 92 and 93 is formed in a disc shape having a larger diameter than the winding drum 91. The flanges 92 and 93 are arranged coaxially with the winding drum 91. The flanges 92 and 93 include respective inner surfaces 92*a* and 93*a* each having an annular shape spreading outward in the radial direction of the winding drum 91. The winding drum 91 includes a fixing hole 91*a* on an outer peripheral surface thereof. A start end portion of the wire 100 is introduced into the winding drum 91 through the fixing hole 91*a*. The wire 100 is fixed to the reel 90 by using the fixing hole 91*a*, is wound onto the outer peripheral surface of the winding drum 91, and is supported by the inner surfaces 92*a* and 93*a* of the flanges 92 and 93. Hereinafter, in the wire 100, a cylindrical part wound onto the winding drum 91 is referred to as a "wound part 100*a*," and a part which is being pulled out from the wound part 100*a* is referred to as a "pulled-out part 100*b*." Moreover, a boundary between the wound part 100*a* and the pulled-out part 100*b* is referred to as a "start end of the pulled-out part 100*b*."

The clip 94 locks the pulled-out part 100*b* of the wire 100 or a terminal end portion of the wire 100. The clip 94 includes a base end portion 94*a* and a tip end portion 94*b*. The base end portion 94*a* is supported by the inner surface 92*a* of the first flange 92 and is located at an inner circumferential side in the radial direction. The tip end portion 94*b* is located at an outer circumferential side in the radial direction. An interval between the tip end portion 94*b* and the inner surface 92*a* is changed by elastic deformation of the clip 94 using the base end portion 94*a* as a fulcrum. As one example, the clip 94 is constituted by a flat-plate spring steel having a substantially rectangular shape. A longitudinal direction and thickness direction of the clip 94 coincide with the radial direction and the axial direction, respectively. The base end portion 94*a* is inserted into a support hole 92*b* formed on the inner surface 92*a* and is supported by the first flange 92 in such a posture as to extend in the radial direction. The tip end portion 94*b* does not project in the radial direction beyond the first flange 92 and is located at substantially the same position as an outer peripheral edge of the first flange 92 in the radial direction.

In the present embodiment, as one example, the single clip 94 is provided only at the first flange 92. However, a plurality of clips 94 may be provided at one flange so as to be spaced apart from each other in the circumferential direction or may be provided at both flanges.

In FIGS. 1A to 1C, the clip 94 is in a no-load state, and the clip 94 is in a closed state. The clip 94 extends in the radial direction along the inner surface 92*a*, and the tip end portion 94*b* is located at a closed position. A gap 95 that is open outward in the radial direction is formed between the tip end portion 94*b* and the inner surface 92*a*. The outer peripheral edge portion of the first flange 92 and/or the tip end portion 94*b* of the clip 94 are/is partially curved such that the gap 95 can be formed. When the clip 94 elastically deforms against biasing force, and the tip end portion 94*b* is displaced inward in the axial direction from the closed position, the interval between the tip end portion 94*b* and the inner surface 92*a* widens, and thus, the clip 94 opens.

The first flange 92 does not include an opening through which the clip 94 is exposed. The clip 94 is covered with the first flange 92 when viewed from an outside in the axial direction. This can increase the rigidity of the first flange 92. In addition, it is possible to avoid a problem that a foreign matter is hooked to the first flange 92 or the clip 94 when distributing or using the reel 90. However, an opening-closing operation of the clip 94 cannot be performed at an outside of the first flange 92 in the axial direction. The wire winding device 1 is applied to the reel 90 configured as above and can automate the opening-closing operation and the locking operation.

Typically, when distributing the wires 100, a supplier winds the wires 100 onto the reels 90 and locks the wires 100, and then ships the wires 100 to users. After the wires 100 are unlocked and used up at destinations, the empty reels 90 are returned to a shipping origin and are reused for winding and shipping of the wires 100. When the reel 90 is repeatedly reused, the reel 90 may deform, and typically, the outer peripheral edge portions of the flanges 92 and 93 may spread outward in the axial direction. The clip 94 is attached to the flange. Even when the positions of the clips 94 (for example, the position of the clip 91 in the axial direction relative to an end of the winding drum or a chucked portion of the first flange) are different from each other among the reels 90 due to the deformation caused by the reuse, the wire winding device 1 can automate the opening-closing operation and the locking operation in accordance with such differences.

Wire Winding Device

Figure 2:
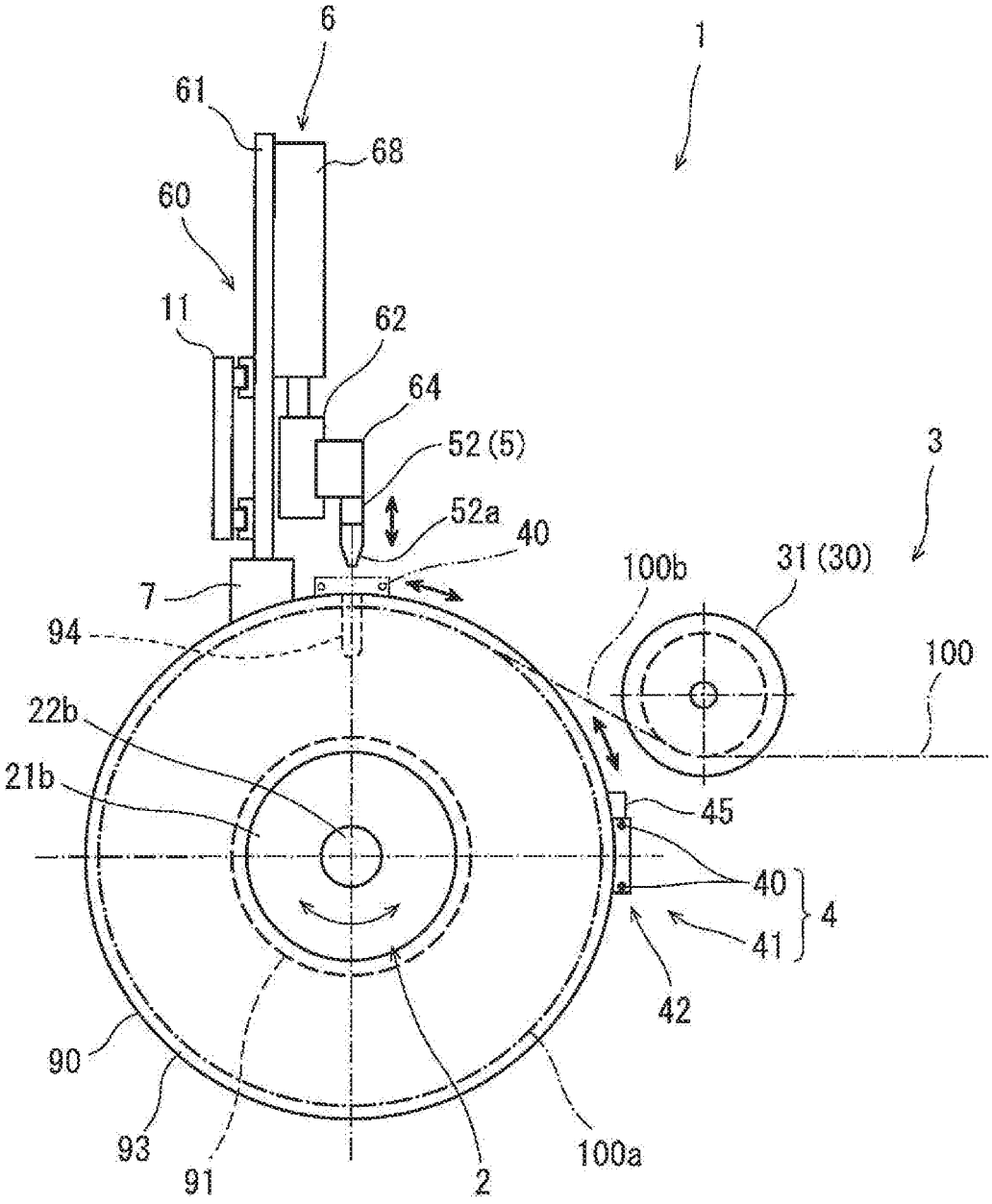
FIG. 2 is a side view showing the wire winding device according to the embodiment.
Figure 3:
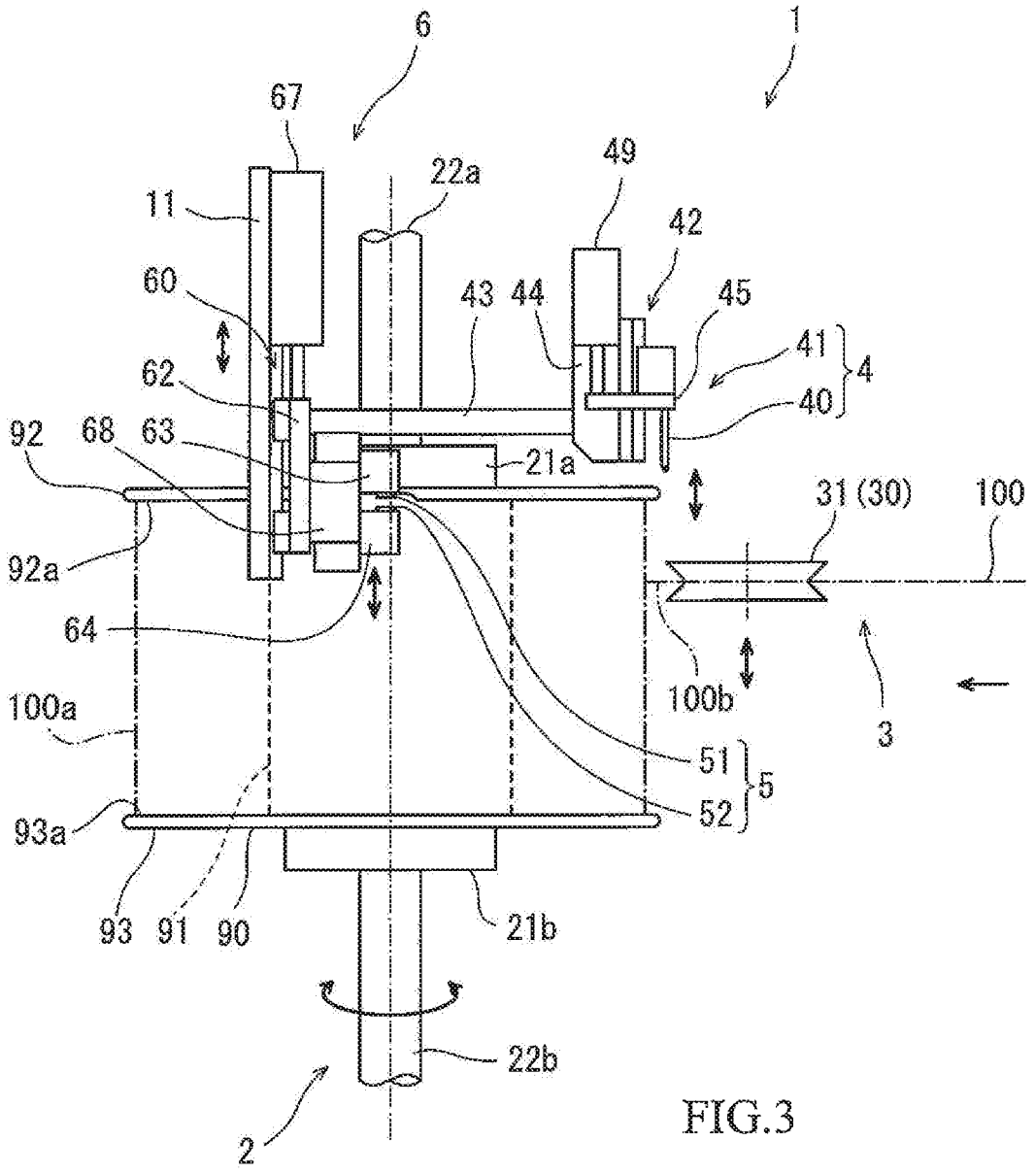
FIG. 3 is a plan view showing the wire winding device according to the embodiment.
Figure 4:
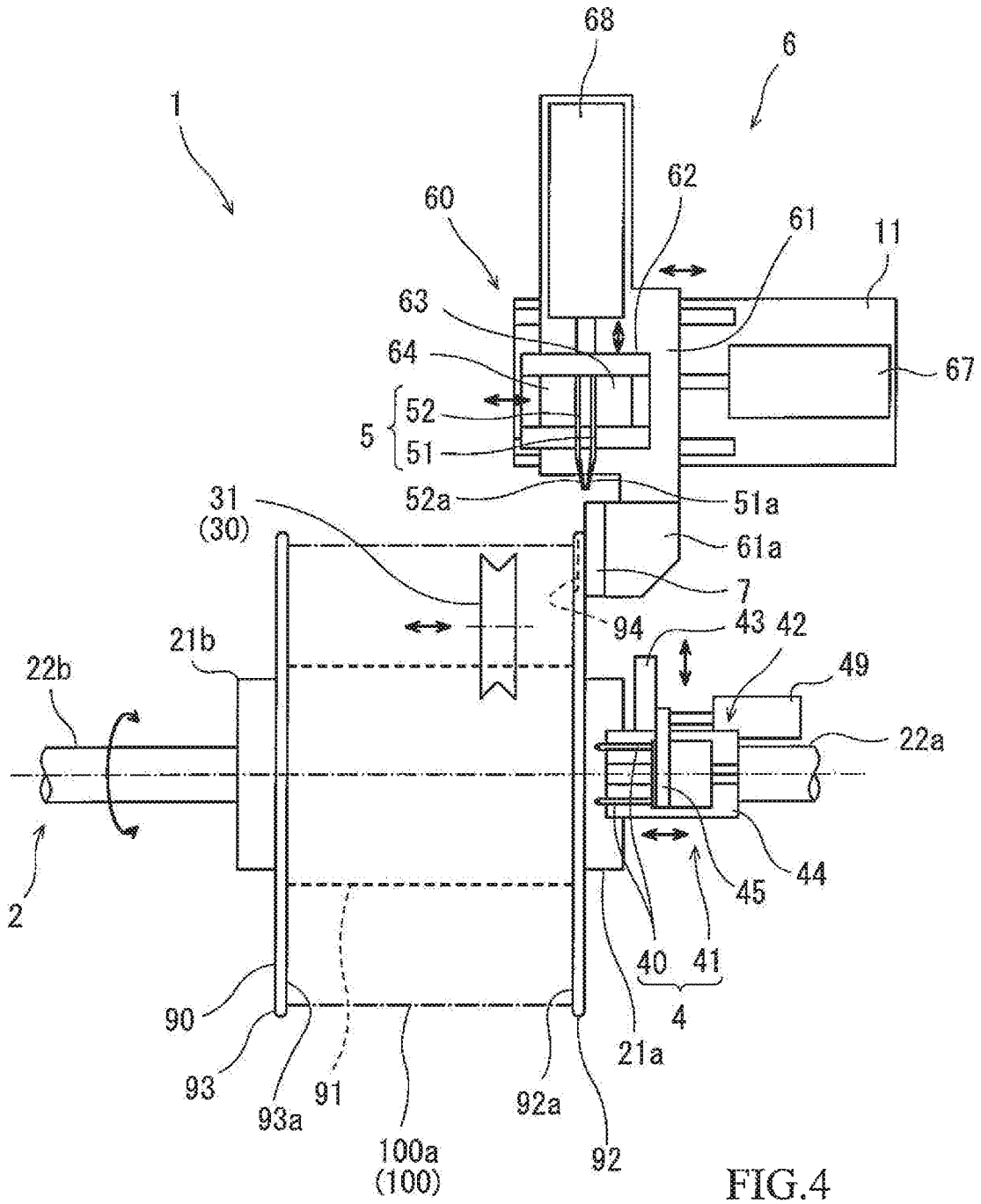
FIG. 4 is a front view showing the wire winding device according to the embodiment.
Figure 5:
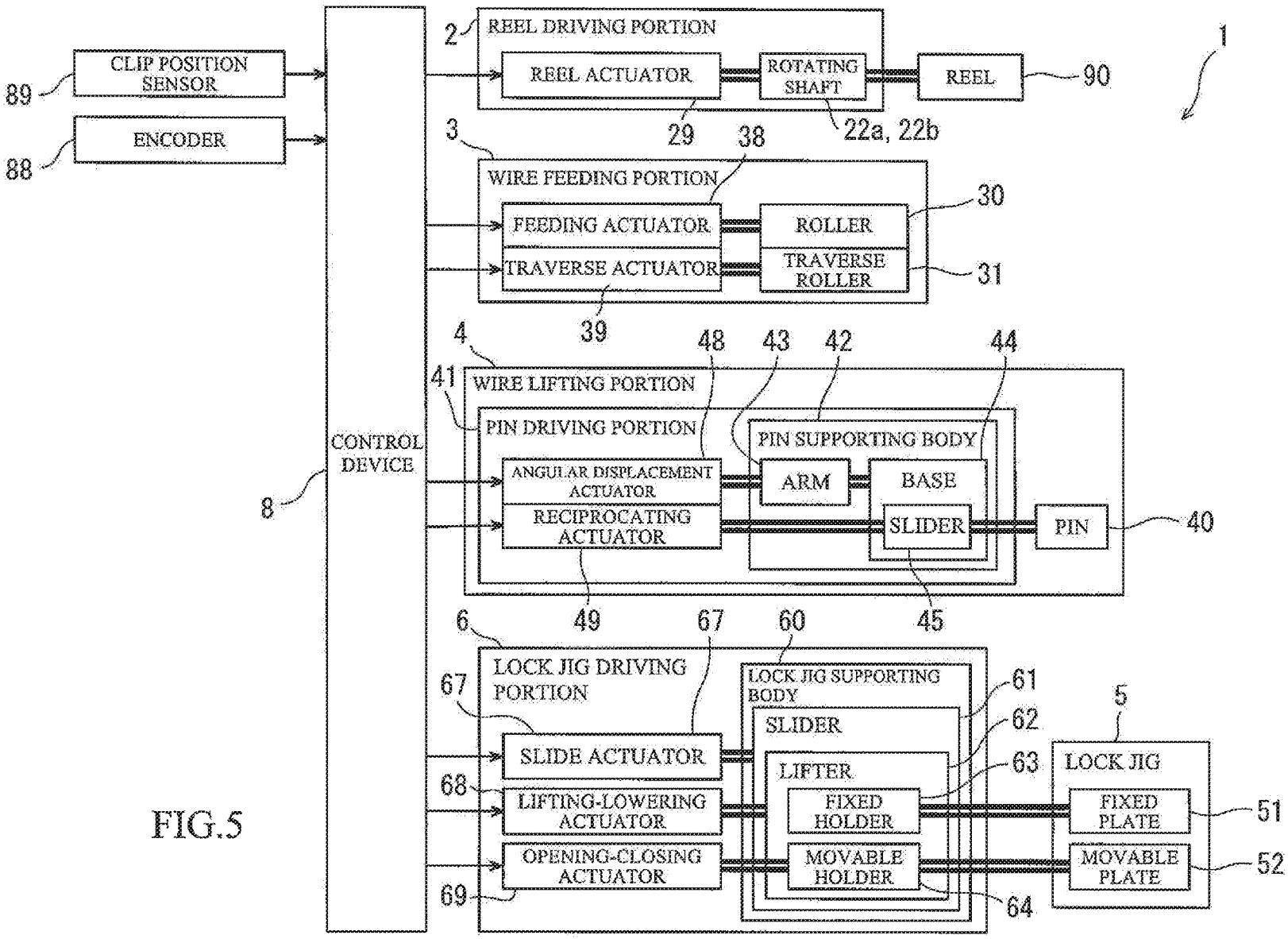
FIG. 5 is a block diagram schematically showing the configuration of the wire winding device according to the embodiment.

FIGS. 2 to 4 show appearance of the wire winding device 1. FIG. 5 is a block diagram schematically showing the configuration of the wire winding device 1. In FIG. 5, single lines show electrical connection, and double lines show mechanical connection. The wire winding device 1 winds the wire 100 onto the reel 90 and locks the wire 100. The wire winding device 1 includes the reel driving portion 2, a wire feeding portion 3, a wire lifting portion 4, a lock jig 5, a lock jig driving portion 6, a position adjustment jig 7, and a control device 8. Although details are not shown in the drawings, the wire winding device 1 includes a fusion-cutting device configured to cut the pulled-out part 100*b* by fusion to separate the wound part 100*a* from a wire supply source after the wire 100 is locked by the clip 94.

Reel Driving Portion

The reel driving portion 2 rotates the reel 90. The reel driving portion 2 includes a pair of air chucks 21*a* and 21*b*, a pair of rotating shafts 22*a* and 22*b*, and a reel actuator 29. The air chucks 21*a* and 21*b* contact respective outer surfaces of the flanges 92 and 93 to sandwich the reel 90. The rotating shafts 22*a* and 22*b* project from respective outer surfaces of the air chucks 21*a* and 21*b* in the axial direction and are supported by a base (not shown in detail) so as to be rotatable. The first air chuck 21*a* contacts the outer surface of the first flange 92 to which the clip 94 is attached. The first rotating shaft 22*a* projects from the outer surface of the first air chuck 21*a* in the axial direction.

The reel actuator 29 rotates one of the rotating shafts 22*a* and 22*b*, and this rotates the reel 90 sandwiched by the pair of air chucks 21*a* and 21*b*. As one example, the reel actuator 29 is constituted by an electric motor.

Wire Feeding Portion

The wire feeding portion 3 supplies the wire 100 to the reel 90 while applying tension (back tension) to the pulled-out part 100*b* of the wire 100. The wire feeding portion 3 includes a plurality of rollers 30 (only one roller is shown), a feeding actuator 38, and a traverse actuator 39. The wire 100 is wound onto outer peripheral surfaces of the plurality of rollers 30 in order, and tangential lines each extending between the two adjacent rollers define a wire feeding route through which the wire 100 is fed from the wire supply source to the reel 90. The feeding actuator 38 rotates some of the rollers 30, and with this, the wire 100 is supplied to the reel 90 along the wire feeding route. The feeding actuator 38 is constituted by an electric motor.

The plurality of rollers 30 include a traverse roller 31. The traverse roller 31 is a roller arranged at a most downstream side in a feeding direction. The traverse roller 31 is located at a position opposed to the reel 90, and the pulled-out part 100*b* is wound onto the traverse roller 31. The traverse roller 31 is configured to be movable in the axial direction. An axis of the traverse roller 31 is parallel to the rotating shafts 22*a* and 22*b* (the reel 90 supported by the reel driving portion 2). A supply position of the wire 100 supplied to the reel 90 can be adjusted in the axial direction by the displacement of the traverse roller 31 in the axial direction. A movable range of the traverse roller 31 reaches the outside of the first flange 92 in the axial direction. The traverse actuator 39 moves the traverse roller 31 in the axial direction. The traverse actuator 39 is constituted by an electric motor or a cylinder.

Wire Lifting Portion

The wire lifting portion 4 lifts the pulled-out part 100*b* outward in the radial direction. Especially, the wire lifting portion 4 lifts a portion of the pulled-out part 100*b* which portion is located between the wound part 100*a* on the winding drum 91 and the outer peripheral surface of the traverse roller 31. The wire lifting portion 4 is arranged close to the first rotating shaft 22*a* and far from the second rotating shaft 22*b*.

The wire lifting portion 4 includes one or more pins 40 and a pin driving portion 41 configured to move the one or more pins 40 in the axial direction and the circumferential direction. The one or more pins 40 are arranged outside the first flange 92 of the reel 90, supported by the reel driving portion 2, in the radial direction. In the present embodiment, the number of pins 40 is two, and the two pins 40 are arranged away from each other in the circumferential direction. An interval between the pins 40 is wider than each of a width of the clip 94 and a width of the lock jig 5.

The pin driving portion 41 moves the pins 40 in the axial direction between an evacuation position where tip ends of the pins 40 are located outside the first flange 92 in the axial direction and an approach position where the tip ends of the pins 40 are located inside the first flange 92 in the axial direction. The pin driving portion 41 moves the pins 40 in the circumferential direction between an initial position (shown by a solid line in FIG. 2) that is a position located in a direction in which the traverse roller 31 is arranged when viewed from a center of the reel 90 (i.e., a direction corresponding to three o'clock in FIG. 2) and a lock position (shown by a two-dot chain line in FIG. 2) that is a position located at an upper side when viewed from the center of the reel 90. The pins 40 are angularly displaceable in an angular range of about 90°. When the pins 40 are located at the lock position, the pins 40 can be opposed to the lock jig 5 in the radial direction (i.e., an upper-lower direction).

The pin driving portion 41 includes a pin supporting body 42, an angular displacement actuator 48, and a reciprocating actuator 49. The pin supporting body 42 supports the pins 40 such that the pins 40 can move in the axial direction and the circumferential direction. The angular displacement actuator 48 moves the pins 40 in the circumferential direction. The reciprocating actuator 49 moves the pins 40 in the axial direction.

As one example, the pin supporting body 42 includes an arm 43, a base 44, and a slider 45. The arm 43 can swing about the same axis as the rotating shaft 22*a* and extends in the radial direction from a rotation axis of the arm 43. The base 44 is fixed to a tip end portion of the arm 43. The slider 45 is supported by the base 44 so as to be able to reciprocate in the axial direction relative to the base 44. The pins 40 are fixed to the slider 45 and is located at an outer circumferential side of the first flange 92 in the radial direction.

The angular displacement actuator 48 makes the arm 43 swing, and this makes the pins 40 move in the circumferential direction. The reciprocating actuator 49 is attached to the base 44 and moves the slider 45 and the pins 40, fixed to the slider 45, in the axial direction. As one example, the angular displacement actuator 48 is constituted by an electric motor, and the reciprocating actuator 49 is constituted by a cylinder.

Lock Jig

The lock jig 5 is formed to have the shape of tweezers and includes a pair of tip end portions 51*a* and 52*a* which can approach each other or separate from each other. The lock jig 5 does not have to be formed in a V shape in which base end portions of the lock jig 5 are coupled to each other. In the present embodiment, the lock jig 5 is constituted by two plate members which are formed separately from each other. One of the plate members is a fixed plate 51, and the other plate member is a movable plate 52. The movable plate 52 is configured to be movable in the axial direction relative to the fixed plate 51. By the movement of the movable plate 52, the tip end portions 51*a* and 52*a* of the plates 51 and 52 approach each other or separate from each other. Thus, the lock jig 5 opens or closes.

Lock Jig Driving Portion

The lock jig driving portion 6 makes the lock jig 5 move and also makes the tip end portions 51*a* and 52*a* approach each other or separate from each other. The lock jig driving portion 6 includes a lock jig supporting body 60, a slide actuator 67, a lifting-lowering actuator 68, and an opening-closing actuator 69. The lock jig supporting body 60 supports the lock jig 5. The slide actuator 67 moves the lock jig 5 in the axial direction. The lifting-lowering actuator 68 moves (lifts or lowers) the lock jig 5 in the radial direction. The opening-closing actuator 69 makes the tip end portions 51*a* and 52*a* approach each other or separate from each other (or opens or closes the lock jig 5).

As with the wire lifting portion 4, the lock jig 5 and the lock jig driving portion 6 are also located close to the first rotating shaft 22*a* and far from the second rotating shaft 22*b*. The lock jig 5 is arranged outside the first flange 92 of the reel 90, supported by the reel driving portion 2, in the radial direction. In the present embodiment, the lock jig 5 is arranged at an upper side of the first flange 92 (in a direction corresponding to twelve o'clock when viewed from the center), and the movement of the lock jig 5 in the radial direction corresponds to an upper-lower movement (lifting and lowering).

As one example, the lock jig supporting body 60 includes a slider 61, a lifter 62, a fixed holder 63, and a movable holder 64. The slider 61 is supported so as to be movable in the axial direction relative to an attachment 11 attached to the base (not shown). The lifter 62 is supported so as to be movable in the upper-lower direction relative to the slider 61. The fixed holder 63 is attached to the lifter 62. The movable holder 64 is supported so as to be movable in the axial direction relative to the lifter 62. A base end portion of the fixed plate 51 is attached to the fixed holder 63, and a base end portion of the movable plate 52 is attached to the movable holder 64. The plates 51 and 52 extends downward from the corresponding holders 63 and 64.

The slide actuator 67 is attached to the attachment 11 and moves the slider 61, i.e., the lock jig 5 in the axial direction. The lifting-lowering actuator 68 is attached to the slider 61 and lifts or lowers the lifter 62, i.e., the lock jig 5. Although not shown in detail, the opening-closing actuator 69 is attached to the lifter 62 and moves the movable holder 64, i.e., the movable plate 52 in the axial direction to open or close the lock jig 5.

Position Adjustment Jig

As described below, the lock jig 5 is used to sandwich the pulled-out part 100*b* or open the clip 94. The lock jig 5 moves at an outside (upper side) of the first flange 92 in the radial direction. Therefore, the slider 61 and the lifter 62 constituting the lock jig supporting body 60 are positioned at an upper side of the reel 90. The slider 61 supporting the lifter 62 includes an extension portion 61*a* extending downward (inward in the radial direction). The position adjustment jig 7 is coupled to the extension portion 61*a*. The position adjustment jig 7 is located at a position which overlaps the first flange 92 when viewed in the axial direction and is located outside the first flange 92 in the axial direction. When the slider 61 moves inward in the axial direction, a surface of the position adjustment jig 7 contacts the outer surface of the first flange 92. With this, the movement of the slider 61, i.e., the lock jig 5 inward in the axial direction is restricted, and the position of the lock jig 5 relative to the reel 90 in the axial direction is adjusted.

Control Portion

As shown in FIG. 5, the control device 8 is connected to an encoder 88 and a clip position sensor 89. The control device 8 is connected to the above-described actuators 29, 38, 39, 48, 49, and 67 to 69. The encoder 88 detects rotation amounts of the rotating shafts 22*a* and 22*b*, i.e., the rotation amount of the reel. The clip position sensor 89 is realized by, for example, an optical sensor and detects a rotational position of the clip 94 attached to the reel 90 supported by the reel driving portion 2. The clip position sensor 89 may detect the clip 94 itself or a detected object whose rotational position relation with the clip 94 (i.e., whose phase difference from the clip 34) is known in advance. The control device 8 executes a program of the wire winding method based on signals output from the encoder 88 and the clip position sensor 89 to drive the actuators 29, 38, 39, 48, 49, and 67-69, the program being prestored in a storage portion of the control device 8. With this, the operations of the reel driving portion 2, the wire feeding portion 3, the wire lifting portion 4, and the lock jig driving portion 6 are controlled. The below-described operations of the portions 2 to 6 are controlled by the control device 8.

Wire Winding Method

Figure 6:
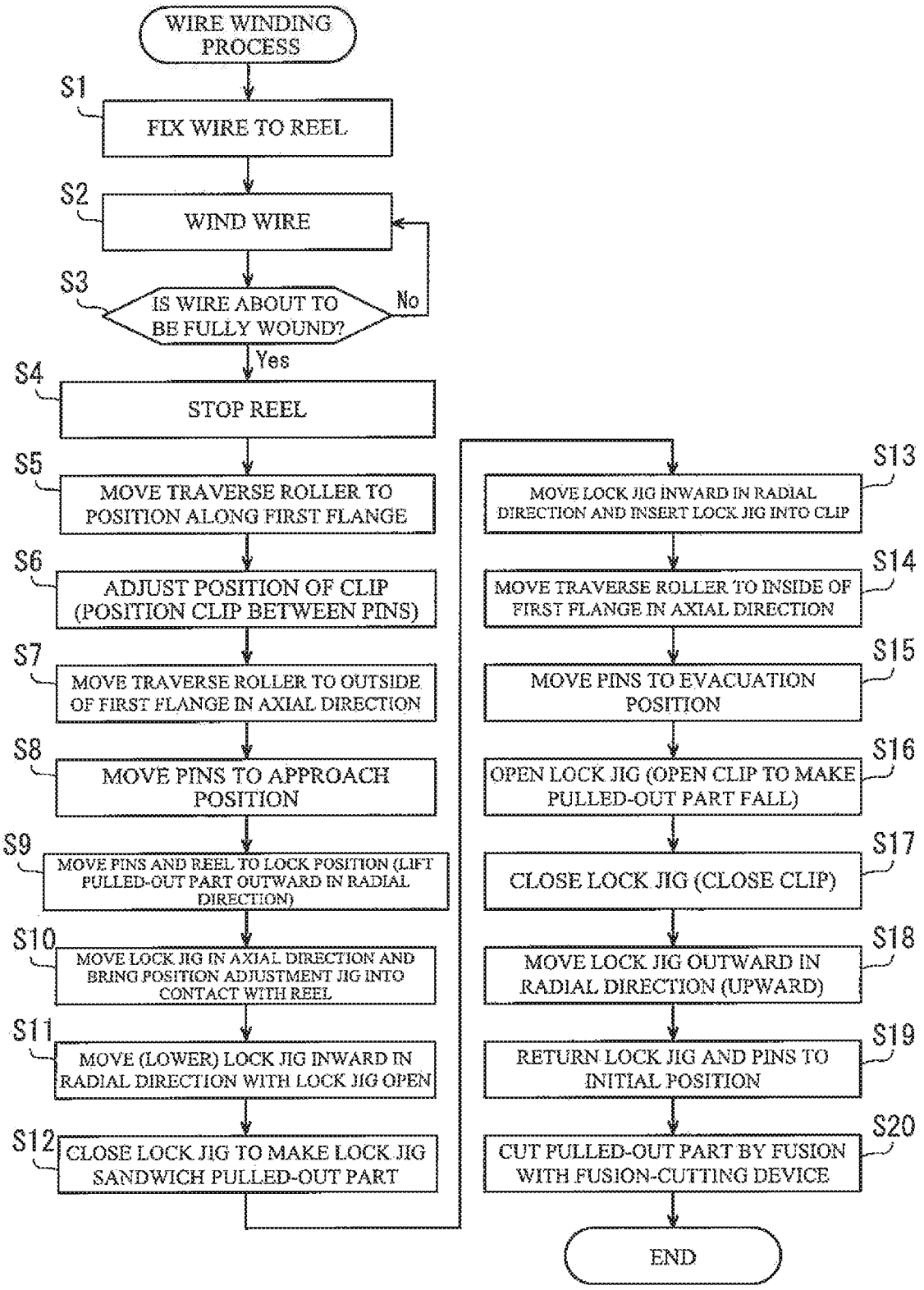
FIG. 6 is a flow chart showing a wire winding method according to the embodiment.

FIG. 6 is a flow chart showing the wire winding method executed by the control device 8 of the wire winding device 1. FIGS. 7A to 7C, 8A to 8C, 9A to 9C, and 10A and 10B are explanatory diagrams of this method. In these drawings, the pins 40 at the evacuation position are shown in white, and the pins 40 at the approach position are shown in black. The lock jig 5 in an open state is shown in white, and the lock jig 5 in a closed state is shown in black.

First, the start end portion of the wire 100 is fixed to the reel 90 (initial step S1). The start end portion of the wire 100 is introduced into the fixing hole 91*a* of the reel 90 supported by the reel driving portion 2. After the initial step S1, the pins 40 are located at the evacuation position in the axial direction and at the initial position in the circumferential direction. The lock jig 5 in an open state is located at the evacuation position in the axial direction and the radial direction (upper-lower direction). When the reel 90 is supported by the reel driving portion 2, the first flange 92 contacts the first air chuck 21*a* located close to the wire lifting portion 4 and the lock jig 5. With this, the clip 94, the wire lifting portion 4, and the lock jig 5 are collectively arranged close to the first rotating shaft 22*a* and far from the second rotating shaft 22*b* in the axial direction.

Next, the wire 100 is wound onto the winding drum 91 (winding step S2). In the winding step S2, the reel driving portion 2 rotates the reel 90. The wire feeding portion 3 feeds the wire 100 to the reel 90 while applying tension to the wire 100. The wire feeding portion 3 makes the traverse roller 31 reciprocate in the axial direction. By the combination of these operations, the wire 100 is wound onto the winding drum 91. During the winding step S2, the control device 8 determines whether or not the wire 100 is about to be fully wound (full-winding determining step S3). The winding step S2 is continued until the wire 100 is about to be fully wound (if No in S3, return to S2). The rotation amount of the reel 90 when the wire 100 is fixed and then fully wound is determined in advance. As one example, a state where "the wire 100 is about to be fully wound" denotes a state where after the wire 100 is fixed, the reel 90 is rotated by a rotation amount which is smaller by a predetermined rotation amount than a rotation amount indicating a state where the wire 100 is fully wound. The control device 8 executes the full-winding determining step S3 based on the signal from the encoder 88.

When the wire 100 is about to be fully wound (Yes in S3), the reel driving portion 2 stops the reel 90 (S4), and the wire feeding portion 3 moves the traverse roller 31 to a position located along the first flange 92 (S5). The two steps S4 and S5 may be performed in parallel.

Figure 7C:
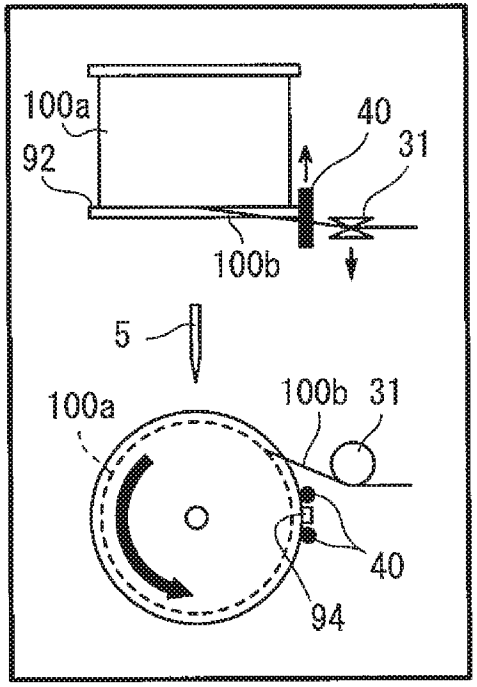
FIGS. 7A to 7C are explanatory diagrams of the wire winding method.
Figure 7B:
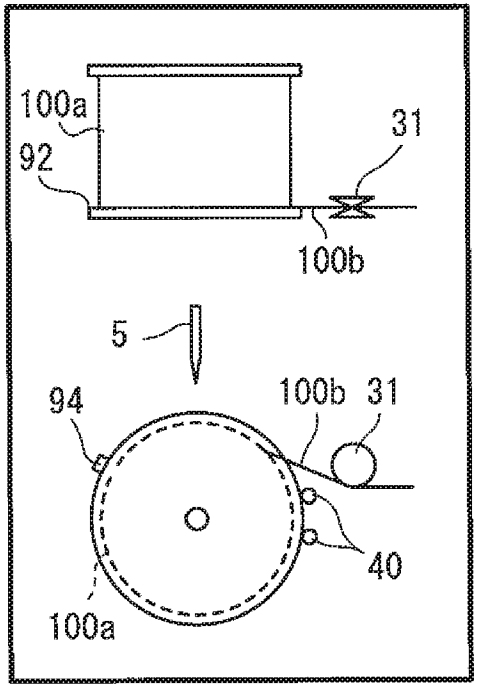
Figure 7A:
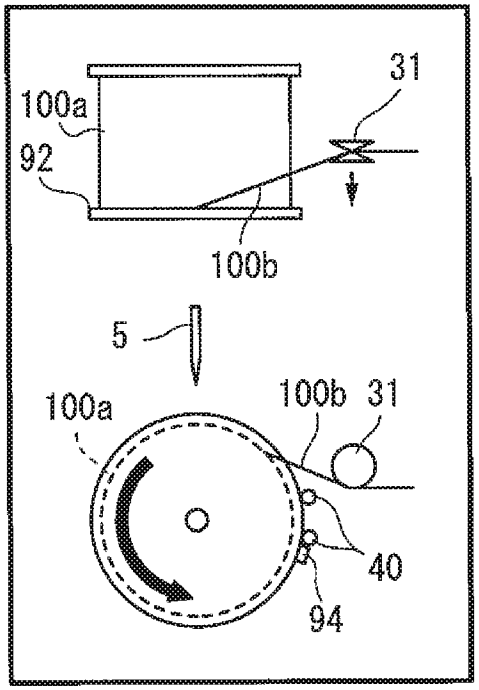

As shown in FIGS. 7A and 7B, the wire 100 is wound onto a lower side of the outer peripheral surface of the traverse roller 31 and supplied to the reel 90. When the wire 100 is fully wound (or when the wire 100 is about to be fully wound), a portion of the traverse roller 31 onto which portion the wire 100 is wound is located lower than an upper end of the wound part 100*a*. The start end of the pulled-out part 100*b* is located closer to the traverse roller 31 than the upper end of the wound part 100*a* in the upper-lower direction and the circumferential direction and is located higher than the portion of the traverse roller 31 onto which portion the wire 100 is wound.

By the movement of the traverse roller 31, the start end of the pulled-out part 100*b* is located at a first axial end portion (end portion close to the first flange 92) of the wound part 100*a*. The pulled-out part 100*b* is linearly pilled out therefrom in the axial direction without being inclined. When the reel 90 stops, the position of the clip 94 in the circumferential direction is random.

Therefore, the position of the clip 94 is adjusted while monitoring the output from the clip position sensor 89 (S6). The reel driving portion 2 rotates the reel 90 at a speed slower than the speed in the winding step S2. As shown in FIG. 7C, when the clip 94 is detected, the clip 94 is stopped at a predetermined position in the circumferential direction. A width of the clip 94 is narrower than the interval between the two pins 40. In the present embodiment, the clip 94 is stopped between the two pins 40.

Next, the traverse roller 31 is moved to the outside of the first flange 92 in the axial direction (S7). As shown in FIG. 7C, the pulled-out part 100*b* is inclined from the start end outward in the axial direction and is pulled out from an inside of the first flange 92 to the outside of the first flange 92 so as to extend over the first flange 92.

Figure 8C:
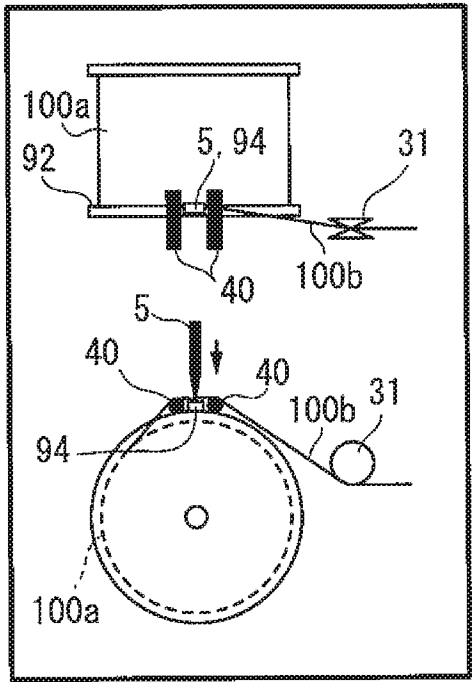
FIGS. 8A to 8C are explanatory diagrams of the wire winding method.
Figure 8B:
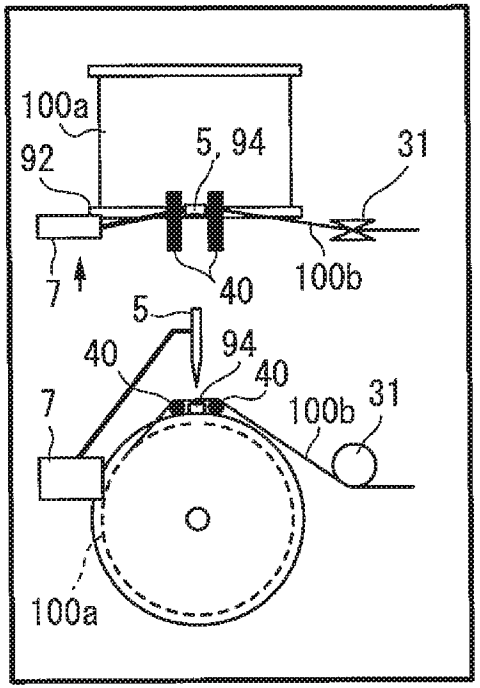
Figure 8A:
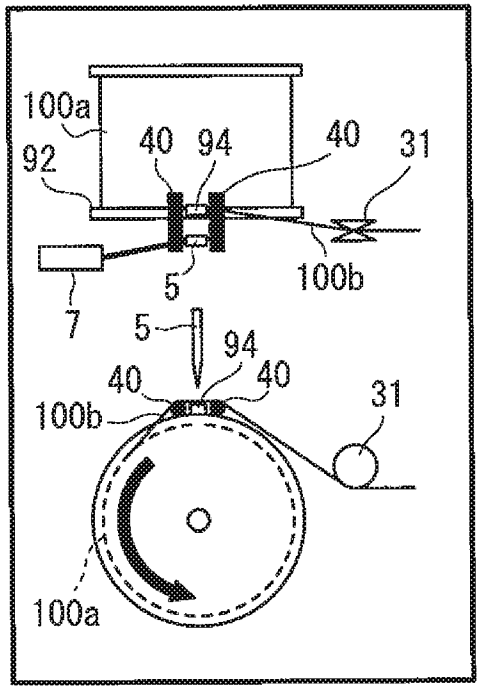

Next, the pins 40 are moved from the evacuation position to the approach position (S8), and the pins 40 and the clip 94 are moved to the lock position (S9). As shown in FIGS. 7C and 8A, when the pins 40 are located at the approach position and are moved from the initial position to the lock position, the pulled-out part 100*b* is hooked to the pins 40 in the middle of this movement of the pins 40. When the pins 40 are moved to the lock position, the pulled-out part 100*b* is lifted from the wound part 100*a* outward in the radial direction (i.e., upward). Specifically, the start end of the pulled-out part 100*b* is located at an opposite side of the traverse roller 31 across the lock position. The pulled-out part 100*b* extends obliquely upward therefrom in an inclined state, extends between the pins 40, and extends obliquely downward from the pins 40 to the outer peripheral surface of the traverse roller 31 in an inclined state. The clip 94 is located between the pins 40 at the lock position. In the present embodiment, the clip 94 is located between the pins 40 before the movement, and in Step S9, the reel 90 rotates in synchronization with the arm 43 of the pin driving portion 41.

Next, the lock jig driving portion 6 moves the lock jig 5 in the axial direction (S10). As shown in FIG. 8B, when the position adjustment jig 7 contacts the first flange 92, the movement stops. As shown in FIGS. 2 and 4, the position adjustment jig 7 contacts a position of the outer peripheral edge portion of the first flange 92 which position is slightly deviated from the clip 94 in the circumferential direction. Therefore, the lock jig 5 can be positioned without making the position of the lock jig 5 deviate from the clip 94 in the axial direction.

Next, the lock jig driving portion 6 moves the lock jig 5 inward in the radial direction (i.e., downward) with the lock jig 5 open (S11). With this, a portion of the pulled-out part 100*b* which portion is being lifted by the wire lifting portion 4 enters between the plates 51 and 52.

Next, the lock jig driving portion 6 closes the lock jig 5 (S12). With this, as shown in FIG. 8C, the pulled-out part 10*a* is sandwiched between the plates 51 and 52.

Figure 9C:
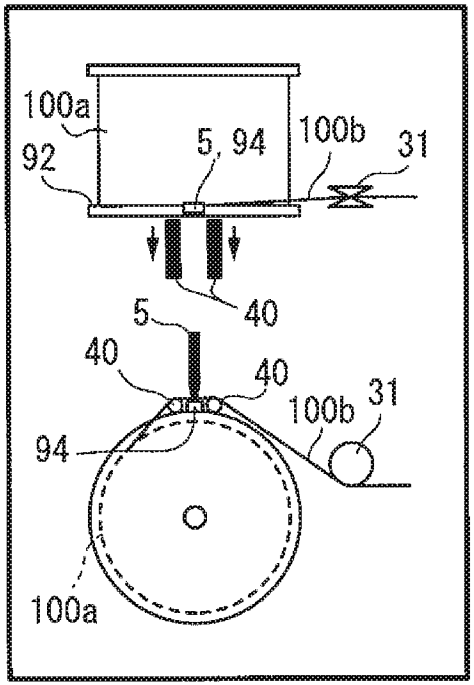
FIGS. 9A to 9C are explanatory diagrams of the wire winding method.
Figure 9B:
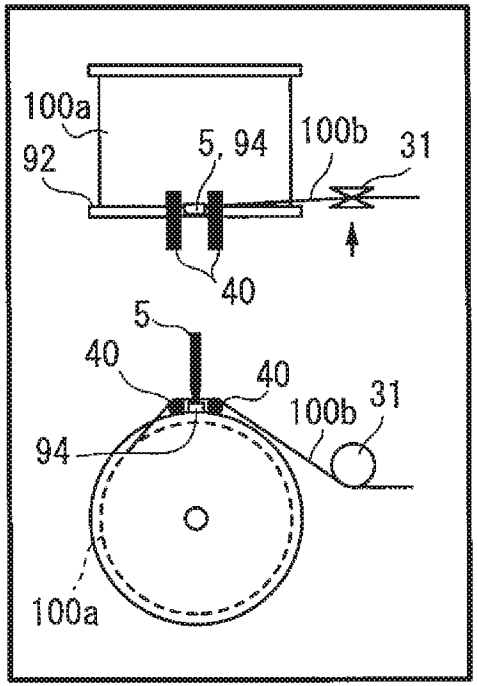
Figure 9A:
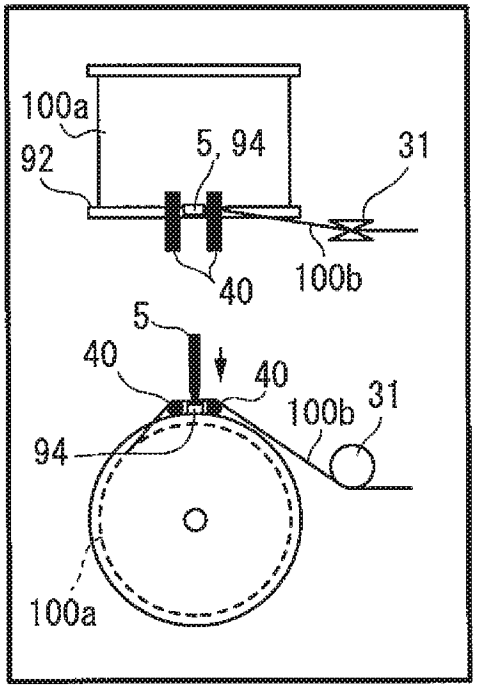

Next, the lock jig driving portion 6 moves the lock jig 5 inward in the radial direction (i.e., downward) with the lock jig 5 closed (S13). With this, as shown in FIG. 9A, the tip end portions of the lock jig 5 are inserted into the clip 94 through the gap 95 of the clip 94.

Next, the wire feeding portion 3 moves the traverse roller 31 to an inside of the first flange 92 in the axial direction (S14). With this, as shown in FIG. 9B, the pulled-out part 100*b* is hooked to the tip end portions of the lock jig 5.

Next, the wire lifting portion 4 moves the pins 40 from the approach position to the evacuation position (S15). With this, as shown in FIG. 9C, the pulled-out part 100*b* is released from the pins 40 of the wire lifting portion 4. Since the traverse roller 31 moves inward in the axial direction, the pulled-out part 100*b* is maintained to be hooked to and lifted by the tip end portions of the lock jig 5.

Next, the lock jig driving portion 6 opens the lock jig 5 (S16). The tip end portion 94*b* of the clip 94 is pushed by the movable plate 52 to be displaced inward in the axial direction against the biasing force. Thus, the clip 94 opens. The pulled-out part 100*b* is released from a state where the pulled-out part 100*b* is hooked to and lifted by the lock jig 5. The back tension is applied to the pulled-out part 100*b*. Therefore, as shown in FIG. 9D, when the pulled-out part 100*b* is released, the pulled-out part 100*b* falls into the clip 94 without being loosened.

Next, the lock jig driving portion 6 closes the lock jig 5 (S17). With this, the clip 94 becomes the no-load state, and the tip end portion 94*b* returns to the closed position.

Figure 10B:
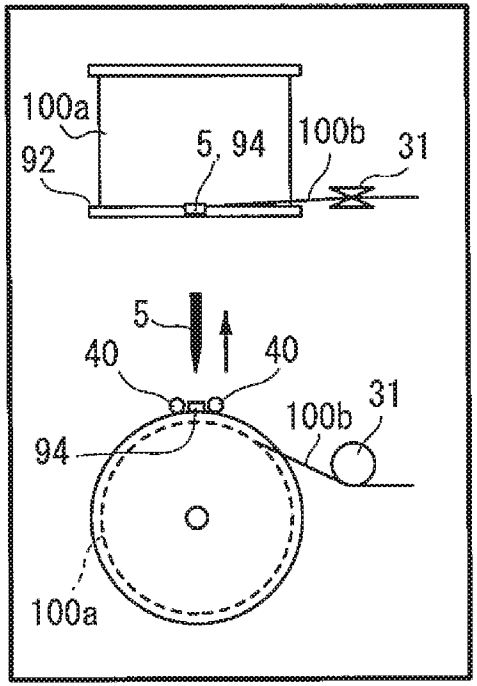
FIGS. 10A and 10B are explanatory diagrams of the wire winding method.
Figure 10A:
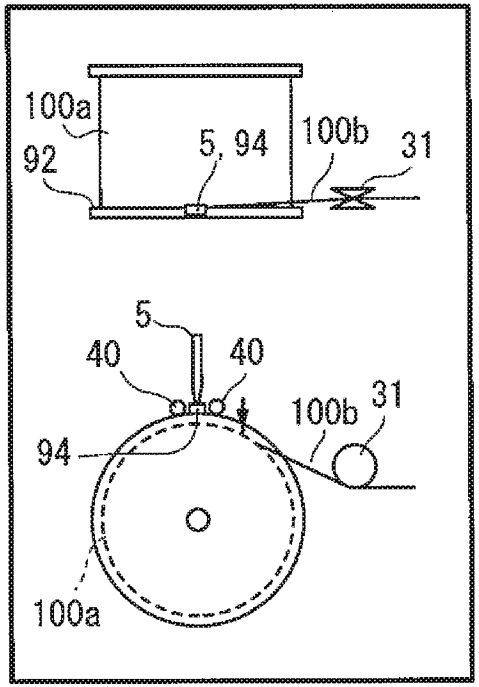

Next, the lock jig driving portion 6 moves the lock jig 5 outward in the radial direction (i.e., upward) with the lock jig 5 closed (S18). With this, as shown in FIG. 10B, the lock jig 5 separates from the clip 94. Thus, the pulled-out part 100*b* is locked to the clip 94.

Next, the lock jig driving portion 6 returns the lock jig 5 to the initial position, and the pin driving portion 41 returns the pins 40 to the initial position (S19). Finally, the fusion-cutting device cuts by fusion a portion of the pulled-out part 100*b* which portion is located between the clip 94 and the traverse roller 31 (S20). With this, the wound part 100*a* on the reel 90 is separated from the wire supply source.

As above, according to the wire winding device 1 and wire winding method of the present embodiment, the operation of opening the clip 94 is performed inside the first flange 92 in the axial direction by the operation of the lock jig 5. Therefore, work of locking the wire 100 to the clip 94 can be automated even in the case of a reel configured such that the opening-closing operation of a clip cannot be performed outside a flange.

The position of the lock jig 5 relative to the clip 94 can be adjusted by the position adjustment jig 7. Therefore, even when the positions of the clips 94 are different from each other among the reels 90 due to the deformation or the like, the opening-closing operation of the clip 94 and the locking operation of the wire 100 can be automated in accordance with such differences.

The foregoing has described the embodiment. Additions, deletions, and/or modifications may be made within the scope of the present invention with respect to the above configuration and method.

The order of Steps S15 and S16 may be reversed. As one example, the lock position is set at the upper side (in a direction corresponding to twelve o'clock) when viewed from the center of the reel 90. However, the lock position may be set to any position in the circumferential direction.

REFERENCE SIGNS LIST

1 wire winding device
2 reel driving portion
3 wire feeding portion
31 traverse roller
4 wire lifting portion
40 pin
41 pin driving portion
42 pin supporting body
5 lock jig
51*a*, 52*a* tip end portion
6 lock jig driving portion
60 lock jig supporting body
7 position adjustment jig
8 control device
89 clip position sensor
90 reel
91 winding drum
92 first flange
92*a* inner surface
93 second flange
94 clip
94*a* base end portion
94*b* tip end portion
95 gap
100 wire
100*a* wound part
100*b* pulled-out part
S2 step of winding wire
S8 step of lifting pulled-out part
S11 step of sandwiching pulled-out part by lock jig
S12 step of inserting lock jig into clip S13 step of opening clip S14 step of releasing wire from wire lifting portion

The invention claimed is:

1. A wire winding device configured to wind a wire onto a winding drum of a reel and lock a pulled-out part of the wire to a clip of the reel, the pulled-out part being pulled out from a wound part of the wire, the clip including a base end portion and a tip end portion, the base end portion being supported by an inner surface of a first flange of the reel and located at an inner circumferential side in a radial direction, the tip end portion being located at an outer circumferential side in the radial direction, an interval between the tip end portion and the inner surface being changed by elastic deformation of the clip using the base end portion as a fulcrum, the wire winding device comprising:

a reel driving portion configured to rotate the reel;

a wire feeding portion configured to supply the wire to the reel while applying tension to the pulled-out part;

a lock jig including a pair of tip end portions configured to approach each other or separate from each other;

a lock jig driving portion configured to make the lock jig move and make the pair of tip end portions of the lock jig approach each other or separate from each other; and a control portion, wherein:

the control portion is configured to execute a step of controlling the reel driving portion and the wire feeding portion to wind the wire onto the winding drum, and a step of controlling the lock jig driving portion to make the lock jig sandwich the pulled-out part, insert the lock jig between the clip and the inner surface, and open the tip end portions of the lock jig against biasing force of the clip to open the clip.

2. The wire winding device according to claim 1, comprising a wire lifting portion configured to lift the pulled-out part outward in the radial direction, wherein:

the control portion is configured to, after the step of winding the wire onto the winding drum, execute a step of controlling the wire lifting portion to lift the pulled-out part outward in the radial direction at a position that overlaps the clip when viewed in the radial direction; and in the step of making the lock jig sandwich the pulled-out part, a portion of the pulled-out part which portion is lifted by the wire lifting portion is sandwiched by the lock jig.

3. The wire winding device according to claim 2, wherein:

the wire lifting portion includes one or more pins arranged outside the first flange in the radial direction and a pin driving portion configured to move the one or more pins in an axial direction and a circumferential direction;

the one or more pins are moved by the pin driving portion in the axial direction between an evacuation position where tip ends of the one or more pins are located outside the first flange in the axial direction and an approach position where the tip ends of the one or more pins are located inside the first flange in the axial direction; and the control portion is configured to control the pin driving portion to move the one or more pins from the evacuation position to the approach position in a space between the pulled-out part and the first flange in the radial direction, move the one or more pins in the circumferential direction to lift the pulled-out part by the one or more pins to an outside of the first flange in the radial direction, and stop the one or more pins such that the clip is opposed to the one or more pins in the radial direction.

4. The wire winding device according to claim 3, wherein:

the one or more pins comprises a pair of pins arranged away from each other in the circumferential direction;

an interval between the pair of pins is wider than each of a width of the clip and a width of the lock jig; and the control portion is configured to control the lock jig driving portion to stop the pins such that the clip is located between the pair of pins when viewed in the radial direction and control the lock jig driving portion to position the lock jig between the pair of pins and make the lock jig sandwich a portion of the wire which portion extends between the pair of pins.

5. The wire winding device according to claim 1, further comprising a clip position sensor configured to detect a rotational position of the clip, wherein the control portion is configured to control the reel driving portion based on the rotational position detected by the clip position sensor, to position the clip at a predetermined lock position and stop the reel, the predetermined lock position being a position to which the lock jig is moved in the radial direction.

6. The wire winding device according to claim 1, wherein:

the wire feeding portion includes a traverse roller onto which the pulled-out part is wound at a position opposed to the reel, the traverse roller being configured to be movable in the axial direction; and the control portion is configured to control the reel driving portion and the traverse roller to wind the wire onto the winding drum while adjusting in the axial direction a supply position of the wire supplied to the reel, and control the traverse roller before the lock jig sandwiches the pulled-out part, to move the traverse roller such that the pulled-out part is pulled out from the wound part to an outside of the first flange in the axial direction.

7. The wire winding device according to claim 1, wherein:

the lock jig driving portion includes a lock jig supporting body supporting the lock jig; and a position adjustment jig configured to adjust a position of the lock jig relative to the reel is coupled to the lock jig supporting body.

8. The wire winding device according to claim 1, wherein the clip is covered with the first flange when viewed from an outside in the axial direction.

9. A wire winding method of winding a wire onto a reel and locking the wire to the reel, the reel including a winding drum onto which the wire is wound, first and second flanges provided at both ends of the winding drum, and a clip to which a pulled-out part of the wire is locked, the pulled-out part being pulled out from a wound part of the wire, the wound part being wound onto the winding drum, the clip including a base end portion supported by an inner surface of the first flange and located at an inner circumferential side in a radial direction and a tip end portion located at an outer circumferential side in the radial direction, an interval between the tip end portion and the inner surface being changed by elastic deformation of the clip using the base end portion as a fulcrum, the method comprising:

a step of winding the wire onto the winding drum; and a step of sandwiching the pulled-out part by a lock jig including a pair of tip end portions configured to approach each other or separate from each other, inserting the lock jig into the clip, and opening the tip end portions of the lock jig against biasing force of the clip to open the clip.

* * * * *